US006178969B1

(12) United States Patent
St. Charles

(10) Patent No.: US 6,178,969 B1
(45) Date of Patent: Jan. 30, 2001

(54) AEROSOL DELIVERY SMOKING ARTICLE

(75) Inventor: Frank Kelley St. Charles, Perry, GA (US)

(73) Assignee: Brown & Williamson Tobacco Corporation, Louisville, KY (US)

( * ) Notice: Under 35 U.S.C. 154(b), the term of this patent shall be extended for 0 days.

(21) Appl. No.: 09/358,386

(22) Filed: Jul. 21, 1999

Related U.S. Application Data

(63) Continuation of application No. 09/033,587, filed on Mar. 3, 1998, now Pat. No. 5,996,589.

(51) Int. Cl.[7] ..... A24F 47/00; A24B 1/00; A24D 3/04; A24D 1/00

(52) U.S. Cl. ..... 131/273; 131/360; 131/335; 131/364; 131/361

(58) Field of Search ..... 131/360, 359, 131/352, 273, 335, 364, 361

(56) References Cited

U.S. PATENT DOCUMENTS

| | | | | |
|---|---|---|---|---|
| 2,030,075 | | 2/1936 | Robinson . | |
| 3,654,045 | * | 4/1972 | Kahn | 161/7 |
| 4,735,217 | | 4/1988 | Gerth . | |
| 4,846,199 | | 7/1989 | Rose . | |
| 4,892,109 | * | 1/1990 | Strubel | 131/194 |
| 5,159,940 | * | 11/1992 | Hayward et al. | 131/194 |

FOREIGN PATENT DOCUMENTS

| | | |
|---|---|---|
| 2704218 | 8/1978 | (DE) . |
| 9218005 | 5/1993 | (DE) . |
| 2700697 | 7/1994 | (FR) . |
| 9828994 | 7/1998 | (WO) . |

* cited by examiner

*Primary Examiner*—Stanley S. Silverman
*Assistant Examiner*—Dionne A. Walls
(74) *Attorney, Agent, or Firm*—Charles G. Lamb; Charles I. Sherman; Middleton & Reutlinger

(57) ABSTRACT

The present invention relate to a smoking device where heated air forms an aerosol which is conveyed to a user without significant burning or combustion of the aerosol supported substrate.

51 Claims, 2 Drawing Sheets

AEROSOL DELIVERY SMOKING ARTICLE

This application is a Continuation of Ser. No. 09/033,587 filed Mar. 3, 1998, now U.S. Pat. No. 5,996,589.

FIELD OF THE INVENTION

The present invention relates to a smoking device. In particular, the invention relates to a smoking device that generates an aerosol in response to heated air.

BACKGROUND OF THE INVENTION

Smoking has been a common pastime in many cultures for probably hundreds of years. Conventionally, smoking has been performed using various devices that involve the combustion of tobacco, such as cigarettes, cigars and pipes. The combustion of tobacco produces smoke which is transmitted to a user. In the case of pipes and cigars, the smoke is typically not inhaled by the user, but in the case of cigarettes, the smoke is inhaled. The flavors included within the smoke caused by combusting tobacco produce a pleasurable effect in the user. Various attempts have been made to produce a smoking device that does not rely on tobacco. Many of these devices are adapted to look like conventional smoking articles such as cigarettes. One such example is the simulated smoking device taught in U.S. Pat. No. 4,284,089 to Ray. The simulated smoking device includes a container having an internal source of nicotine. The source of nicotine does not completely fill the air passageway of the container. Thus, a constricted region of the air passageway is created within the source of nicotine. Upon the application of suction by a user at one end of the container, pressure is reduced in the constricted portion of the passageway which causes nicotine to be released from the source of nicotine and enter the passing air.

In another device, shown in European Patent No. 0 198 268 to Ellis et al., a smoking device is disclosed which includes a housing for receiving a conventional cigarette at one end and a mouthpiece at the other end for delivering cigarette smoke to a user. Located between the mouthpiece and the conventional cigarette is a nicotine dispensing unit.

Still other devices have been developed as an alternative to conventional smoking articles. These articles generally attempt to simulate conventional cigarettes without the combustion of tobacco products. For example, many devices include an internal aerosol forming material that is heated by an internal heating element. The heating stimulates the production of a flavorful aerosol for delivery to a user of the device. The internal heating element has conventionally been either a carbonaceous fuel element, or an electrochemical heat source such as combinations of metal oxide, anhydrous metal sulfide, metal sulfate, inorganic salt and a sugar which generate heat on contact with water. In these devices, the cigarette is not capable of being reused. Once the carbonaceous fuel element is lit it continues to burn unattended until all the fuel in the element is consumed. The lit fuel element is very difficult to extinguish, either with water or other means for extinguishment. If based on an electrochemical reaction, difficulty is also encountered in stopping the reaction which only terminates when all the reactants are consumed. Other devices include an electrical heating element for stimulating an aerosol forming substance. Although these are capable of being turned off between puffs, the electrical heating element requires a battery which is clumsy.

It would be desirable to provide an article that closely simulates a conventional cigarette but does not require the combustion of tobacco and can be reused as well. A need also exists for an article where the timing for individual puffs is determined by the user, and not controlled by the time or type of reaction. It would further be desirable to minimize, if not eliminate, combustion by-products of the substrate while heating air is drawn through the device.

SUMMARY OF THE INVENTION

According to the present invention, a smoking device (article) delivers an aerosol to a user by air at an elevated temperature that passes through the article to contact an aerosol forming component, without significant burning or combustion of the substrate. The article includes a hollow tube defining an air passageway extending between a heating end and a user (mouth) end of the tube. The tube is resistant to burning upon application of a flame or any suitable heating element. An aerosol forming substrate fills and is positioned within the passageway so that the substrate is recessed from the heating end of the tube. As a result, an air gap of a predetermined length is defined between the distal end of the substrate and the heating end of the tube for delivering hot gases from the heat source, e.g. flame, to the substrate without igniting the substrate. The hot gases form and convey the aerosol, which is typically flavored, to the mouth end of the tube upon application of suction.

BRIEF DESCRIPTION OF THE DRAWINGS

The above-described advantages and salient features of the present invention will be more fully appreciated with reference to the following specification and appended figures.

DETAILED DESCRIPTION OF THE INVENTION

Figure 1:
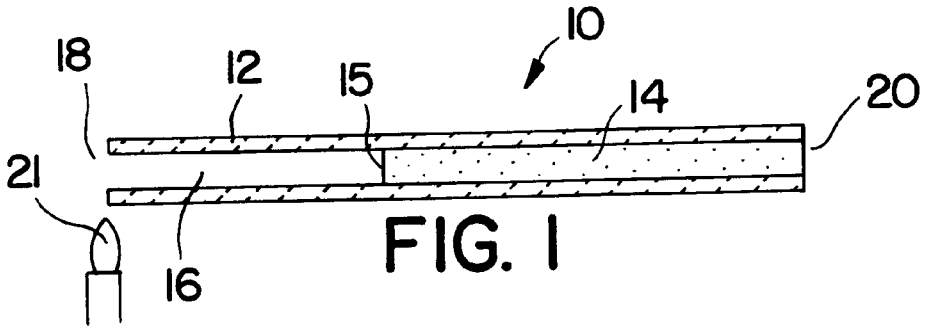
FIG. 1 depicts an article in accordance with the present invention.

FIG. 1 depicts article 10 that includes a tube 12 surrounding an aerosol forming substrate 14. As used herein, the aerosol forming substrate 14 is a substrate containing an aerosol forming component. The tube 12 is hollow and defines an air passageway between a heating end 18 and a user/mouth end 20. The tube 12 is heat resistant and will not burn upon application of a flame 21 to the heating end 18. Suitable materials for use as the tube 12 will be set forth below in greater detail.

The aerosol forming substrate 14 is positioned within the tube to fill the inner diameter of the tube. In addition, the aerosol forming substrate 14 is positioned within the tube so that its distal end 15 is recessed from the heating end 18 of the tube 12. The tube has an internal diameter "d" of between 3 and 16 mm. The gap 16 is of sufficient length to prevent direct contact of a flame with the distal end of the aerosol supported substrate. The distal end of the substrate 14 is preferably recessed from the heating end of the tube a distance of between 2 and 10 times the gap diameter "d". Therefore, the gap is at least 6 mm. This forms an air gap or conduit 16 between the heating end 18 and the distal end of the substrate 14. The air conduit 16 provides a path for hot gases to enter the article 10 from the flame 21 to heat the substrate 14 without igniting or substantially burning the substrate 14. The aerosol forming substrate is air transmissive, thus creating an air transmissive path from the mouth end 20 of the tube 12 to the heating end 18. The aerosol forming substrate 14 also contributes an aerosol to heated air that passes through it.

Figure 7:
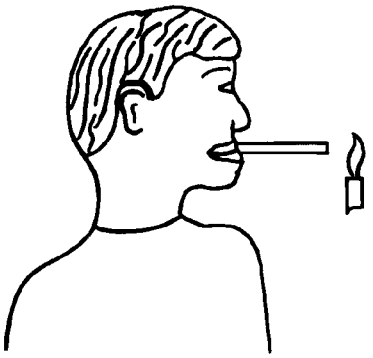
FIG. 7 depicts the operation of the present invention by a user.

During use of the article 10, as seen in FIG. 7, a user applies a flame 21 to the heating end 18 of the tube 12. This causes hot air and hot gases from the flame 21 to enter the air conduit 16 within the tube 12 when the user applies suction with his/her mouth to the mouth end 20 of the tube 12. This causes the hot gases produced by the flame 21 to enter the air passageway within the tube 12. As the user applies suction, the hot gases travel through the aerosol forming substrate 14, which dispenses an aerosol to the hot gases. Then, the hot air with the aerosol pass into the mouth of the user producing a pleasurable effect.

The air conduit or gap 16 is typically at least two centimeters in length and preferably between two and six centimeters in length. The length of the gap is chosen in order to convey hot gases from the flame 21 to the substrate 14 without substantially burning or igniting the substrate 14. The length of the air conduit 16, in order to accomplish this goal, depends upon the diameter of the tube 12. Two to six centimeters is preferred for a tube of conventional cigarette dimensions. If the diameter of the tube 12 is different, the distal end 15 may be recessed more or less than the above range in order to preserve an aspect ratio between the length of recess and the diameter of the tube 12.

The aerosol forming substrate 14 is comprised of a support material having one or more distillable substances imbued therein. Suitable support materials include virtually anything that is porous enough to transmit air and absorbent enough to retain distillable substances. Preferred support materials include fibrous cellulosic material such as paper, cotton, wood pulp, and combinations thereof. In addition, the support material may be tobacco or reconstituted tobacco, carbonized cellulosic material, metal wool, ceramic wool, and porous ceramic. In addition, polymeric materials having sufficient porosity and absorbency may be used.

Distillable substances for imbibing into the support material are selected to provide a pleasurable sensation to the user. The distillable substances should volatilize in response to heating by the hot gases from the flame 21. Suitable distillable substances include water, polyhydric alcohols such as glycerin, propylene glycol, triethylene glycol, glycerol triacetate, triethylene glycol diacetate and combinations thereof. Other examples are tobacco extract, tobacco pyrolysates, aliphatic esters of mono-di-or poly-carboxylic acids, such as methyl stearate, dimethyl dodecandioate, dimethyl tetradecandioate, and mixtures thereof. In addition, flavors may be added to the distillable substances to produce a desired taste effect. Examples of flavorings include cocoa butter, chocolate liquor, waxes, oils, and combinations thereof. In addition, menthol flavor may be added to simulate sensations produced by conventional menthol cigarettes.

The distillable substances may be imbued into the support material by dipping the support material into a mixture of distillable substances or by spraying the distillable substances onto the support material. Alternatively, the distillable substance mixture may be forced into the support material under pressure. The aerosol forming substrate 14 may be inserted into a preformed tube 12, or the tube 12 may be wrapped around the aerosol forming substrate 14, or the substrate 14 may be wrapped in a combustion resistant wrapper and the resulting article inserted into the tube 12.

The tube 12 is non-combustible upon application of a flame or at least not easily ignited. Suitable materials for the tube 12 are ceramic, meerschaum, metal, paper, paper board, reconstituted tobacco, wood, bamboo, glass, metal foil, and combinations thereof. Any of the foregoing materials may be treated to prevent combustion. Chemical treatments for reducing a propensity for combustion are well known in the art.

In addition, suitable plastics such as Bakelite may be used for the tube 12. The tube 12 may be formed in any convenient manner such as for example, injection blow molding, extrusion and conventional molding. When the tube is preformed, the aerosol forming substrate 14 is typically inserted into the formed tube 12. Alternatively, the tube 12 may be formed from a planar member or sheet, for example, a chemically treated piece of paper. When the article 10 is made using a sheet for the material of the tube 12, the sheet is typically rolled around the aerosol forming substrate 14 during manufacture. While particular examples of forming the article 10 have been set forth, it will be understood that any convenient method of manufacturing the article 10 may be used. For example, the tube 12 may be made of a composite of materials. In addition, the tube 12 may be integral or monolithic, or may include a plurality of sections or may be layered.

Figure 2:
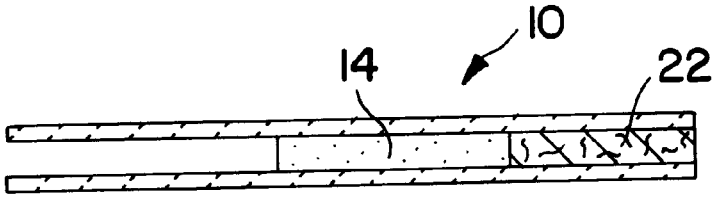
FIG. 2 depicts an article having both an internal filter and an aerosol forming substrate.

FIG. 2 depicts an alternate embodiment of the invention, in which the article 10 further comprises a filter 22. The filter 22 is disposed between the aerosol forming substrate 14 and the mouth end 20 of the tube 12. The filter 22 may simply give the article 10 a more similar appearance to a conventional cigarette. Alternatively, the filter 22 may perform a useful function of filtering the gas delivered to the user.

Figure 3:
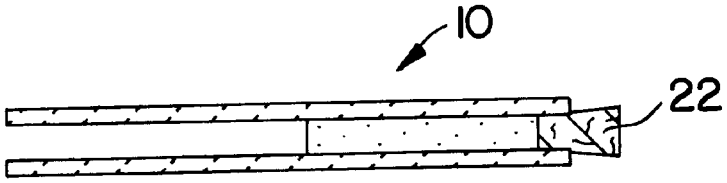
FIG. 3 depicts an article according to the present invention having an aerosol forming substrate and a partially positioned internal filter.

FIG. 3 depicts yet another embodiment of the article 10 in which the filter 22 is partially within the mouth end 20 of the tube 12 and partially outside. In this configuration, a user may grip the filter for ease of removal. This design also limits insertion depth of the article and better control of the gap.

Figure 4:
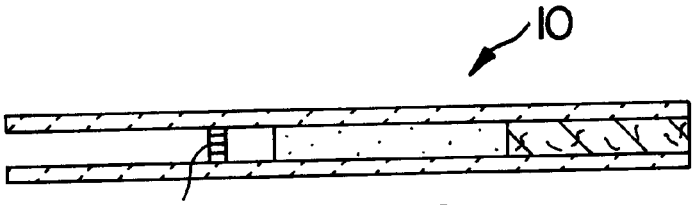
FIG. 4 depicts an article according to the present invention including a heat diffuser.

In yet another embodiment shown in FIG. 4, a heat diffuser 24 is inserted into the air conduit between the distal end of the aerosol forming substrate 14 and the heating end 18. The heat diffuser serves to deliver the hot gases from the flame 21 to the aerosol forming substrate 14 through holes contained within the diffuser 24. In addition, the heat diffuser 24 blocks the flame from contact with the aerosol forming substrate 14 upon the application of suction at the mouth end 20 by the user. This facilitates preventing ignition and substantial burning of the aerosol forming substrate 14. The heat diffuser 24 may also be treated with a catalyst for converting carbon monoxide into carbon dioxide. The heat diffuser 24 may also be treated with other catalysts for eliminating certain hydrocarbons produced by various types of flames and heating elements. The flame 21 may be produced for example by a match, a butane lighter, or a gaseous lighter incorporating any other type of gas for controlled combustion. It is also within the scope of the invention to fixedly or removably attach the lighter to the end of tube 10. Conversely, a heating element that does not flame may be used to introduce the hot gases into the tube 12. In a preferred embodiment of the invention, the heat diffuser 24 is a wire mesh.

Figure 5A:
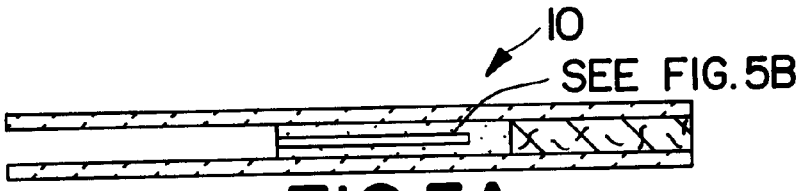
FIG. 5A depicts an article according to the present invention including a heat diffuser in the form of a perforated diffuser tube.
Figure 5B:
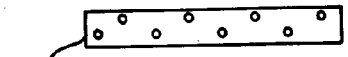
FIG. 5B is an enlarged view of the perforated tube depicted in FIG. 5A.

FIGS. 5A and 5B show yet another alternate embodiment of the invention wherein the heat diffuser is in the form of a hollow perforated diffuser tube 26. The hollow perforated diffuser tube 26 is inserted within the aerosol forming substrate 14. Such a diffuser tube facilitates the transmission of the hot gases from the flame 21 to a larger surface area of the aerosol forming substrate 14. In addition, the diffuser tube may lower the pressure drop across the aerosol forming substrate 14, thus rendering it more easy for a user to suck gases from the heating end 18 to the mouth end 20. In this configuration, the proximal end of the diffuser tube 26 which is adjacent to the mouth end 20 of the tube 12 does not completely extend beyond the aerosol forming substrate 14. Therefore, there is no direct path for air at the heating end 18 to reach the mouth end 20 without going through the aerosol generating substrate 14.

As was indicated above, the filter 22 may or may not be used. When the filter 22 is used, it typically abuts the proximal end of the aerosol forming substrate 14 at one end. When it is not used, the proximal end of the aerosol forming substrate 14 is nearly coincident with the mouth end of the tube 12.

Figure 6A:
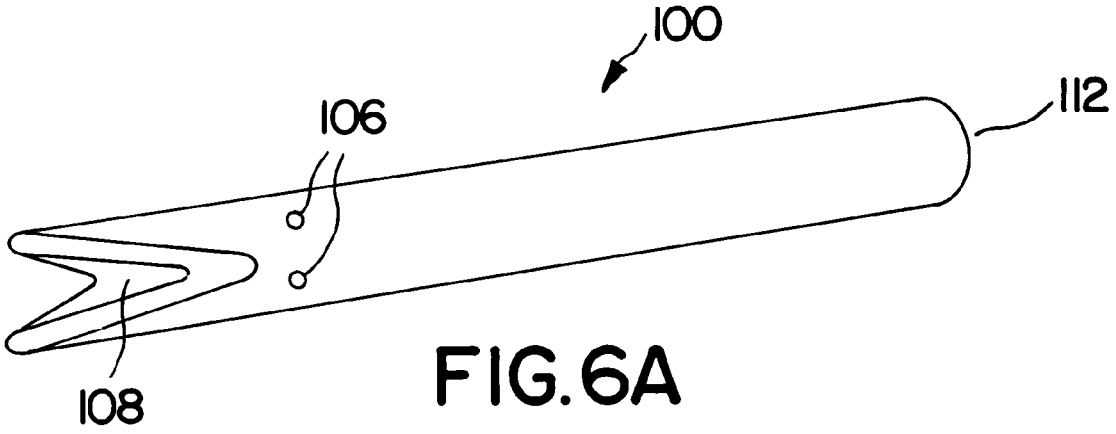
FIGS. 6A and 6B depict an alternative housing for the article of the present invention.
Figure 6B:
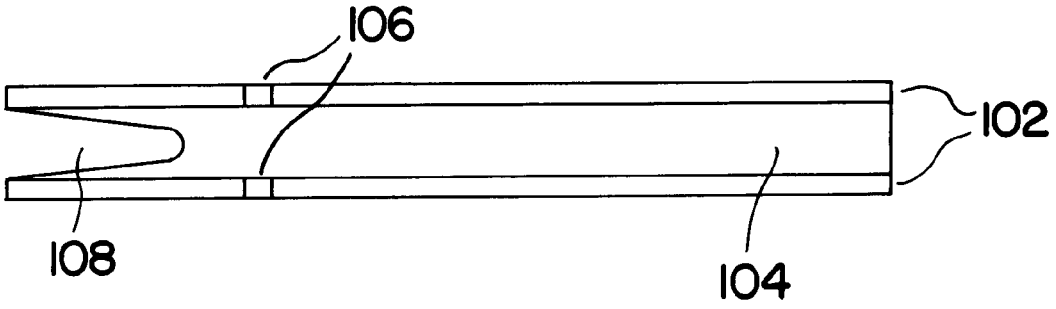

In FIGS. 6A and 6B, the Article 10 includes a tube 100 having a thickness 102, an inner diameter 104 also includes openings 106 and cutout 108. The use of openings 106 ensures the proper use of the article. If the user does not place the charge in tube 100 to form the distal gap (gap 16 in FIG. 1), air will be drawn into the holder through holes 106 instead of the end 112 of holder 100. Tube 100 is also provided with cut-out 104, which permits easy removal of a filter bearing substrate.

Although specific embodiments of the invention have been disclosed, it will be understood by those of ordinary skill in the art that changes may be made to those embodiments without departing from the spirit and scope of the invention. For example, in the preferred embodiment of the present invention, the article has the dimensions of a conventional cigarette. However, the dimensions including the diameter, length, and shape of the tube may be changed without departing from the scope of the invention.

What is claimed is:

1. An article for delivering an aerosol to a user, consisting essentially of:

an open-ended hollow tube having an air passageway between a heat receiving end at one end and a mouth end at an opposed end, said heat receiving end being an open end of said hollow tube;

said tube being substantially non-combustible upon application of heat to said heat receiving end;

a substrate containing an aerosol forming component;

said substrate being positioned within said air passageway and having a distal end;

said distal end being spaced from said heat receiving end to form a continuous air gap between said heat receiving end and said distal end;

said continuous air gap having a length of at least two centimeters;

said continuous air gap preventing combustion of said substrate upon application of said heat to said heat receiving end; and, said aerosol forming component forming an aerosol upon application of a suction to said mouth end and application of said heat to said heat receiving end.

2. The article of claim 1, wherein:

said tube has an internal diameter of between three and sixteen millimeters.

3. The article of claim 2, wherein:

said distal end is recessed from said heat receiving end a distance of between two and ten times said internal diameter.

4. The article of claim 1, said continuous air gap being between two and six centimeters.

5. The article of claim 1, said continuous air gap having a length adapted to prevent substantial combustion of said substrate upon application of said heat to said heat receiving end and to allow said aerosol forming component to form an aerosol upon application of a suction to said mouth end and application of said heat to said heat receiving end.

6. The article of claim 1, said open-ended hollow tube having an internal diameter, said continuous air gap having a length which is proportional to said internal diameter, said length being sufficient to prevent substantial combustion of said substrate upon application of said heat to said heat receiving end.

7. The article of claim 1 having an internal diameter defining said air passageway, said continuous air gap having a length between two and ten times said internal diameter.

8. The article of claim 1, wherein:

said continuous air gap is maintained during usage of said article.

9. The article of claim 1, wherein:

said tube is plastic.

10. The article of claim 1, said hollow tube being combustion resistant.

11. The article of claim 1, further comprising:

a heating element attached to said heat receiving end.

12. The article of claim 1 including a cigarette lighter attached to said heat receiving end.

13. An article for delivering an aerosol to a user, consisting essentially of:

an open-ended hollow tube defining an air passageway between a heat receiving end and a mouth end thereof;

said tube being non-combustible upon application of a flame from a cigarette lighter;

a substrate containing an aerosol forming component;

said substrate being positioned within said air passageway and having a distal end;

said distal end being spaced from said heat receiving end to form a continuous air gap between said heat receiving end and said distal end;

said continuous air gap having a length of between two and six centimeters;

said continuous air gap preventing substantial combustion of said substrate upon application of said flame from said cigarette lighter to said heat receiving end; and said aerosol forming component forming an aerosol upon application of a suction to said mouth end and application of said flame from said cigarette lighter to said heat receiving end.

14. The article of claim 13, wherein:

said tube has an internal diameter of between three and sixteen millimeters.

15. The article of claim 14, wherein:

said length is between two and ten times said internal diameter.

16. The article of claim 13, wherein:

said distal end is recessed from said heat receiving end a distance sufficient to prevent direct contact of a flame with said distal end.

17. The article of claim 13, wherein:

said tube is plastic.

18. The article of claim 13, wherein:

said continuous air gap is maintained during usage of said article.

19. The article of claim 13, further comprising:

a heating element attached to said heat receiving end.

20. An article for delivering an aerosol to a user consisting essentially of:

an open-ended hollow tube having an air passageway between a heat receiving end and a mouth end at an opposed end, said heat receiving end being an open end of said hollow tube;

a heating element attached to said heat receiving end;

said tube being substantially non-combustible upon application of heat from said heating element;

a substrate containing an aerosol forming component;

said substrate being positioned within said air passageway and having a distal end;

said distal end being spaced from said heat receiving end to form a continuous air gap between said heat receiving end and said distal end;

said continuous air gap having a length of at least two centimeters;

said continuous air gap preventing combustion of said substrate upon application of said heat to said heat receiving end; and said aerosol forming component forming an aerosol upon application of a suction to said mouth end and application of said heat to said heat receiving end.

21. The article of claim 20, wherein said tube has an internal diameter of between three and sixteen millimeters.

22. The article of claim 21 wherein said distal end is recessed from said heat receiving end a distance of between two and ten times said internal diameter.

23. The article of claim 20 wherein said tube is plastic.

24. The article of claim 20 wherein said continuous air gap is maintained during usage of said article.

25. The article of claim 20, said hollow tube being combustion resistant.

26. The article of claim 20, said continuous air gap being between two and six centimeters.

27. The article of claim 20, said continuous air gap having a length adapted to prevent substantial combustion of said substrate upon application of said heat to said heat receiving end and to allow said aerosol forming component to form an aerosol upon application of a suction to said mouth end and application of said heat to said heat receiving end.

28. The article of claim 20, said open-ended hollow tube having an internal diameter, said continuous air gap having a length which is proportional to said internal diameter, said length being sufficient to prevent substantial combustion of said substrate upon application of-said heat to said heat receiving end.

29. The article of claim 20 having an internal diameter defining said air passageway, said continuous air gap having a length between two and ten times said internal diameter.

30. An article for delivering an aerosol to a user consisting essentially of:

an open-ended hollow tube having an air passageway between a heat receiving end and a mouth end thereof;

a heating element attached to said heat receiving end;

said tube being non-combustible upon application of said heat from said heating element;

a substrate containing an aerosol forming component;

said substrate being positioned within said air passageway and having a distal end;

said distal end being spaced from said heat receiving end to form a continuous air gap between said heat receiving end and said distal end;

said continuous air gap having a length of at least two centimeters;

said continuous air gap preventing substantial combustion of said substrate upon application of said heat from said heating element; and said aerosol forming component forming an aerosol upon application of a suction to said mouth end and application of said heat from said heating element.

31. The article of claim 30 wherein said tube has an internal diameter of between three and sixteen millimeters.

32. The article of claim 31 wherein said length is between two and ten times said internal diameter.

33. The article of claim 30 wherein said tube is plastic.

34. The article of claim 30 wherein said continuous air gap is maintained during usage of said article.

35. An article for delivering an aerosol to a user consisting essentially of:

an open-ended hollow tube having an air passageway between a heat receiving end and a mouth end at an opposed end, said heat receiving end being an open end of said hollow tube;

a cigarette lighter attached to said heat receiving end;

said tube being substantially non-combustible upon application of a flame from said cigarette lighter;

a substrate containing an aerosol forming component;

said substrate being positioned within said air passageway and having a distal end;

said distal end being spaced from said heat receiving end to form a continuous air gap between said heat receiving end and said distal end;

said continuous air gap having a length of at least two centimeters;

said continuous air gap preventing combustion of said substrate upon application of said flame to said heat receiving end; and said aerosol forming component forming an aerosol upon application of a suction to said mouth end and application of said flame to said heat receiving end.

36. The article of claim 35, wherein said tube has an internal diameter of between three and sixteen millimeters.

37. The article of claim 36 wherein said distal end is recessed from said heat receiving end a distance of between two and ten times said internal diameter.

38. The article of claim 35 wherein said distal end is recessed from said heat receiving end a distance sufficient to prevent direct contact of said flame with said distal end.

39. The article of claim 35 wherein said tube is plastic.

40. The article of claim 35 wherein said continuous air gap is maintained during usage of said article.

41. The article of claim 35, said hollow tube being combustion resistant.

42. The article of claim 35, said continuous air gap being between two and six centimeters.

43. The article of claim 35, said continuous air gap having a length adapted to prevent substantial combustion of said substrate upon application of said flame to said heat receiving end and to allow said aerosol forming component to form an aerosol upon application of a suction to said mouth end and application of said flame to said heat receiving end.

44. The article of claim 35, said open-ended hollow tube having an internal diameter, said continuous air gap having a length which is proportional to said internal diameter, said length being sufficient to prevent substantial combustion of said substrate upon application of said flame to said heat receiving end.

45. The article of claim 35 having an internal diameter defining said air passageway, said continuous air gap having a length between two and ten times said internal diameter.

46. An article for delivering an aerosol to a user consisting essentially of:

an open-ended hollow tube having an air passageway between heat receiving end and a mouth end thereof;

a cigarette lighter attached to said heat receiving end;

said tube being non-combustible upon application of said flame from said cigarette lighter;

a substrate containing an aerosol forming component;

said substrate being positioned within said air passageway and having a distal end;

said distal end being spaced from said heat receiving end to form a continuous air gap between said heat receiving end and said distal end;

said continuous air gap having a length of at least two centimeters;

said continuous air gap preventing substantial combustion of said substrate upon application of said flame from said cigarette lighter; and said aerosol forming component forming an aerosol upon application of a suction to said mouth end and application of said flame from said cigarette lighter.

47. The article of claim 46 wherein said tube has an internal diameter of between three and sixteen millimeters.

48. The article of claim 47 wherein said length is between two and ten times said internal diameter.

49. The article of claim 46 wherein said distal end is recessed from said heat receiving end a distance sufficient to prevent direct contact of said flame with said distal end.

50. The article of claim 46 wherein said tube is plastic.

51. The article of claim 46 wherein said continuous air gap is maintained during usage of said article.

* * * * *